US006229517B1

(12) United States Patent
Enz

(10) Patent No.: US 6,229,517 B1
(45) Date of Patent: May 8, 2001

(54) DISPLAY OR INDICATING DEVICE

(75) Inventor: Emil Enz, Gais (CH)

(73) Assignee: ENZ-Electronic AG, Gais (CH)

( * ) Notice: Subject to any disclaimer, the term of this patent is extended or adjusted under 35 U.S.C. 154(b) by 0 days.

(21) Appl. No.: 09/166,085

(22) Filed: Oct. 5, 1998

(30) Foreign Application Priority Data

Oct. 6, 1997 (CH) ..... 2342/97

(51) Int. Cl.[7] ..... G06G 3/34; G06G 3/30

(52) U.S. Cl. ..... 345/108; 345/110; 345/111; 345/76

(58) Field of Search ..... 345/108, 111, 345/76; 340/815.71, 815.62, 815.64

(56) References Cited

U.S. PATENT DOCUMENTS

| | | | | |
|---|---|---|---|---|
| 4,074,253 | * | 2/1978 | Nadir | 345/111 |
| 4,531,318 | | 7/1985 | Chang et al. | 340/815.27 |
| 4,794,391 | * | 12/1988 | Costa et al. | 345/108 |
| 6,025,825 | * | 2/2000 | Kao | 345/108 |

FOREIGN PATENT DOCUMENTS

| | | |
|---|---|---|
| 0291122 | 11/1988 | (EP) . |
| 2543336 | 9/1984 | (FR) . |
| 8706047 | 10/1987 | (WO) . |

* cited by examiner

*Primary Examiner*—Richard Hjerpe
*Assistant Examiner*—Benjamin D. Bowers
(74) *Attorney, Agent, or Firm*—Browdy and Neimark

(57) ABSTRACT

The display or indicating device comprises at least one display unit (1) having a display dot (10) as well as having means for actuating the display dot. The latter has a pivotably mounted baseplate (11) which is provided with an electroluminescence apparatus (30). Spurs (14, 15) protrude from the baseplate (11) and are mounted such that they can rotate in bearing sleeves (23, 24) made of an electrically conductive material. The electrodes (31, 32) of the apparatus (30) extend right into the region of the spurs or the bearing sleeves. Fitted on the respective spur (14, 15) is a contact element (36), which is electrically connected to the electrode that is present here. The bearing sleeves (23, 24) are fitted on supports (22) made of an electrically conductive material, these supports being connected to a supply source. The display dot (10) is provided with a permanent magnet (8). The display unit (1) furthermore comprises a magnetic circuit (25) and the latter is assigned to the display dot (10) in such a way that the display dot (10) can change its position.

12 Claims, 4 Drawing Sheets

DISPLAY OR INDICATING DEVICE

The present invention relates to a display or indicating device having display units which display the picture to be reproduced in a dot-by-dot manner, the respective display unit comprising a display dot as well as means for actuating said display dot.

Such a display or indicating device is already known. The dot of the respective display unit has a baseplate. The mutually opposite large areas of said baseplate have a high color contrast. One of the large areas of the baseplate is black, while the other large area is yellow, for example. The baseplate carries a permanent magnet. The display unit furthermore comprises a controllable magnetic circuit having an approximately U-shaped yoke. The dot plate is assigned to the poles of this yoke which, together with the permanent magnet, enables the display dot to be adjusted. This display or indicating device furthermore comprises a light source which is placed in front of the dots of the display units and is permanently in operation, if required. If nothing is to be displayed, then the black side of all the display dots faces the viewer. In order to display a picture, those display units which are to be involved in the display of the picture are driven. In the case of these units, the display dot is rotated such that its yellow side faces the viewer. The yellow surface of the display dot reflects the light from the light source to the viewer.

This previously known display or indicating device must be arranged relative to the viewer in such a way that the light source which is placed in front of the display units does not dazzle the viewer. As a rule, the display units form horizontal rows lying one above the other. The light source is usually arranged underneath the panel of display units and at a specific distance in front of said panel. In this case, the display dots of the lower rows appear to be brighter than the display dots of the upper rows, which adversely affects the reading of the information that is to be communicated by such a device. Owing to the light source and owing to the necessity of arranging the latter at a distance in front of the display panel, such display or indicating devices have considerable dimensions which cannot be reduced in this system of display.

The object of the present invention is to eliminate the abovementioned disadvantages and also still further disadvantages of the prior art.

In the case of the device of the generic type mentioned in the introduction, this object is achieved according to the invention in the manner defined in the characterizing part of patent claim 1.

Figure 1:
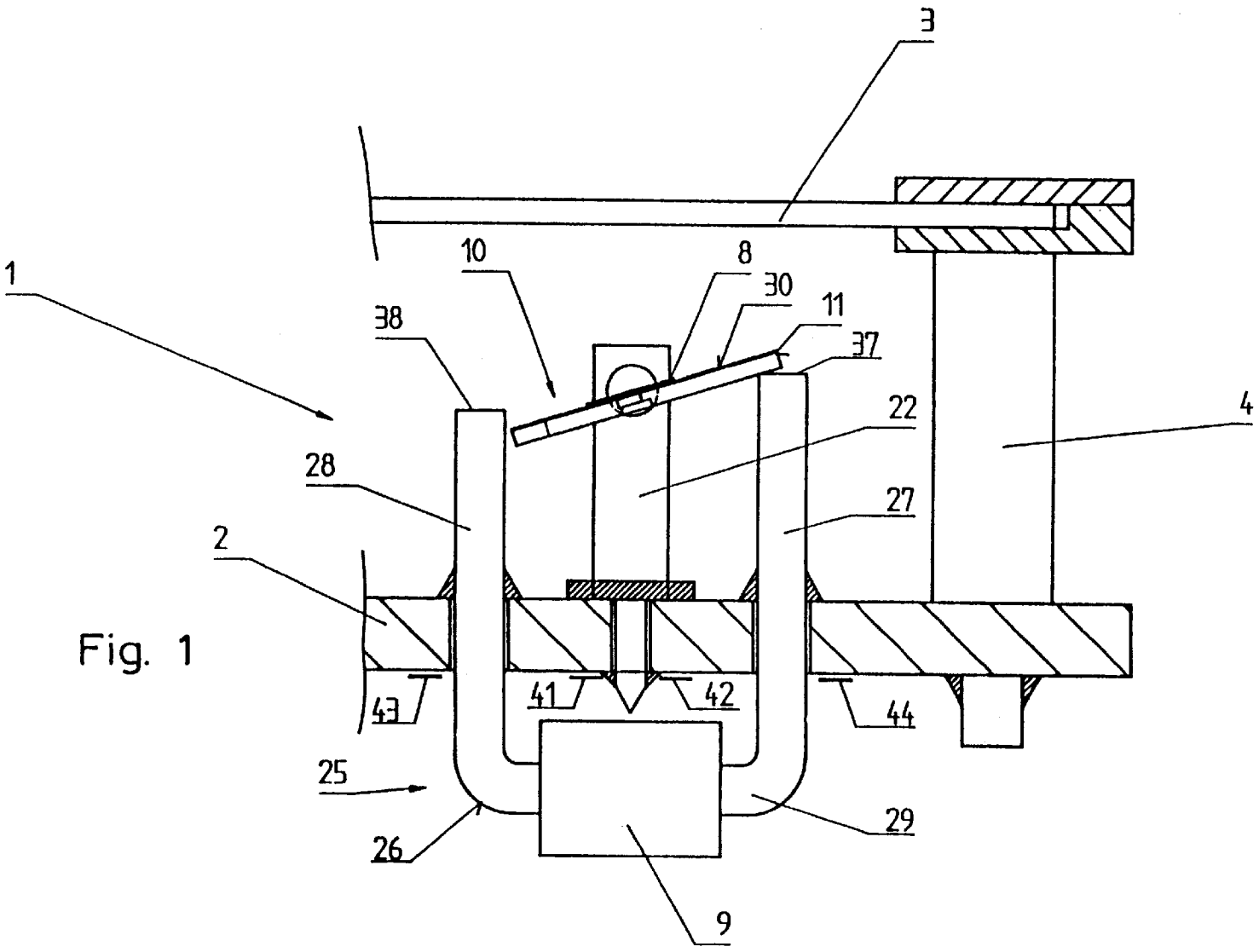
Figure 2:
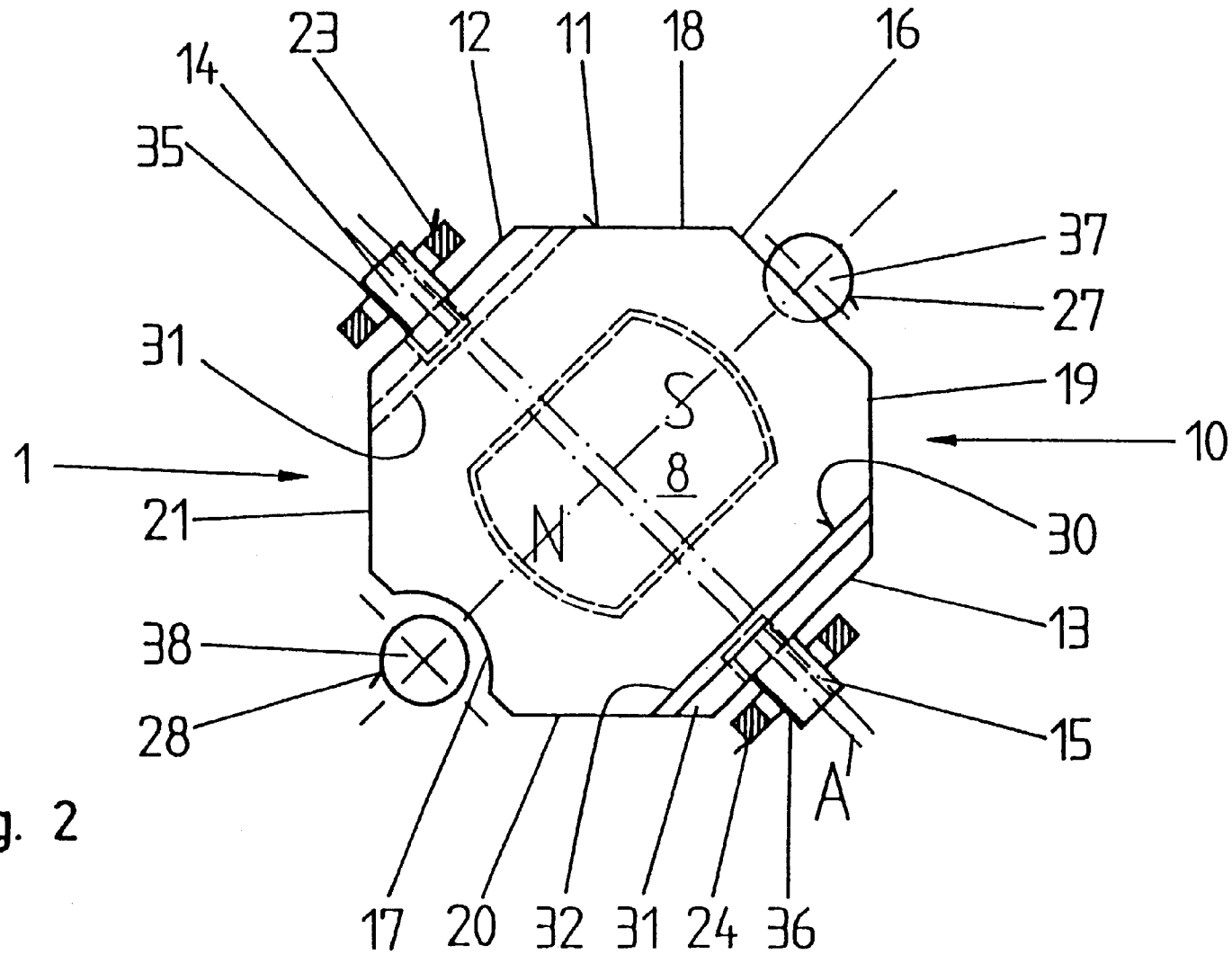
Figure 3:
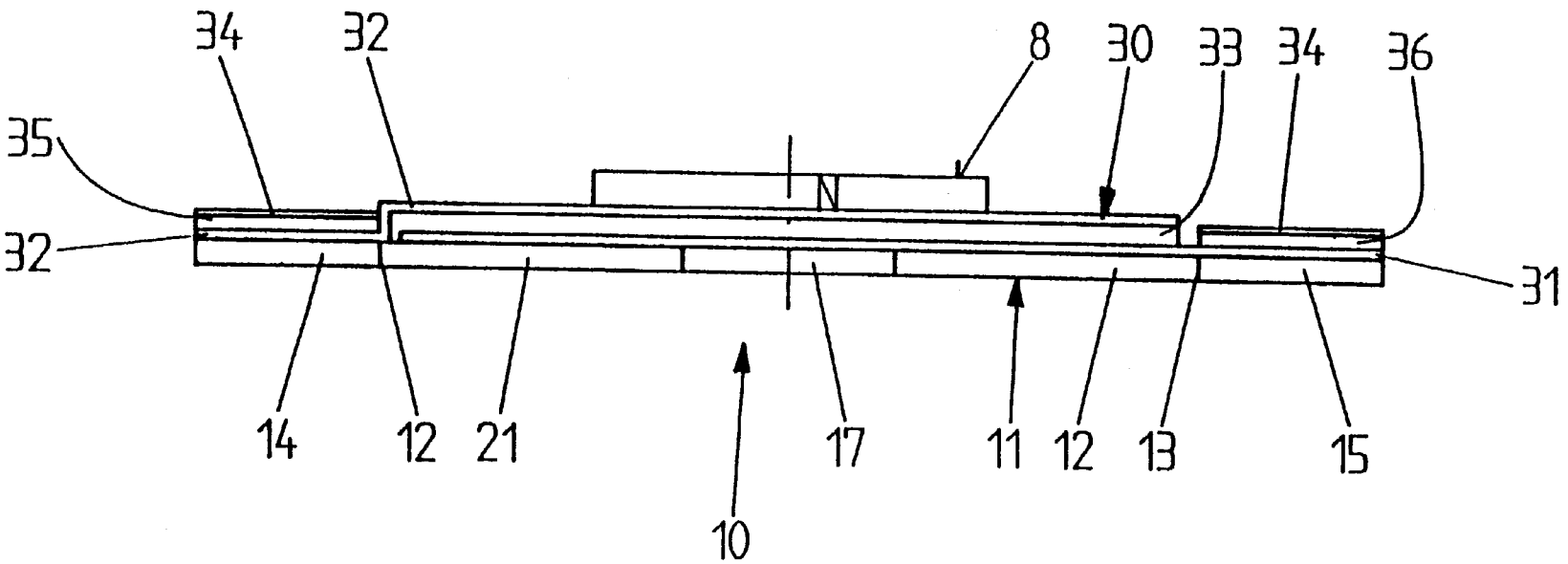
Figure 5:
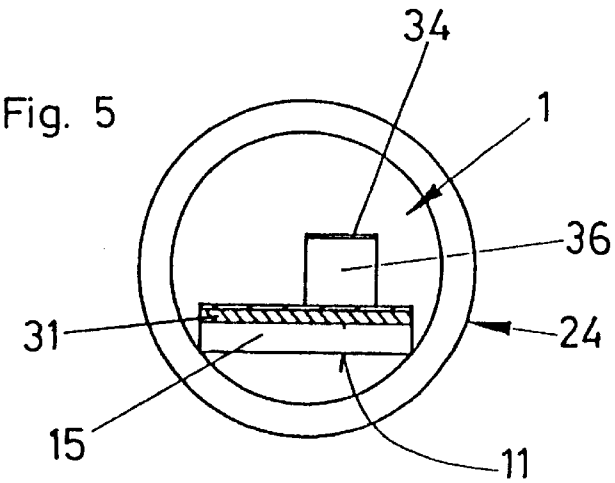
Figure 6:
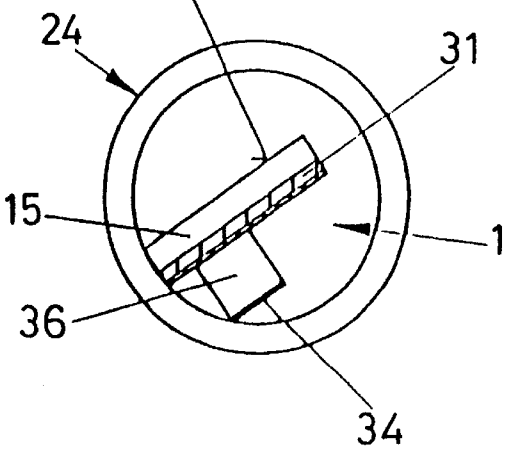
Figure 4:
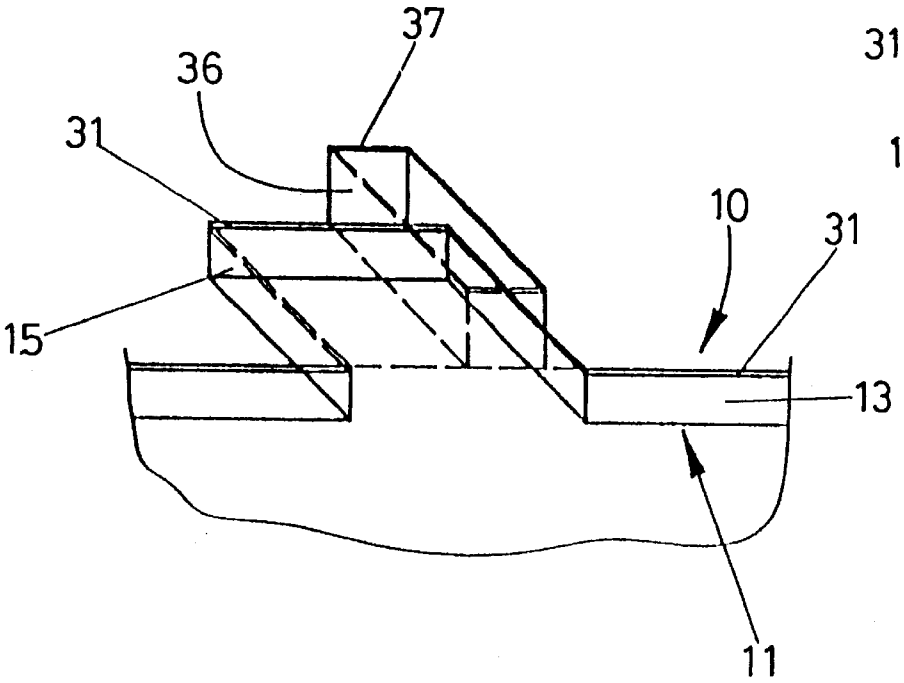

Embodiments of this invention are explained in more detail below with reference to the appended drawings, in which:

FIG. 1 shows a side view of the most essential part of one of the display units of the present device, which contains, inter alia, a baseplate with a luminescence apparatus, FIG. 2 shows a plan view of the display unit from FIG. 1, FIG. 3 shows the luminescence apparatus from FIG. 1 enlarged and in a side view, FIG. 4 shows an end portion of the baseplate according to FIG. 1 in a perspective and enlarged view, FIG. 5 shows a side view of the end portion of the baseplate illustrated in FIG. 4 when the display unit is out of operation, and FIG. 6 shows a side view of the end portion of the baseplate illustrated in FIG. 4 when the display unit is in operation.

The present display or indicating device has display units 1, just one of which is illustrated in a side view in FIG. 1. Such display units 1 serve to display the picture to be reproduced in a dot-by-dot manner and, in the present device, they form rows which run parallel to one another and are carried by a plate 2. In the present case, conductor tracks 41, 42, 43 and 44 and also components (not illustrated) which are necessary for the electrical connection and operation of the display units 1 can also be fitted on the carrying plate 2. The present device also comprises a transparent front plate 3, which is placed in front of the display units 1 as protection against undesirable mechanical effects. This protective plate 3 is fastened to the carrying plate 2 via spacers 4.

The respective display unit 1 comprises a display dot 10 as well as means for actuating this display dot 10. The method of operation of this display dot 10 utilizes the electroluminescence effect. The display dot 10 has a baseplate 11, which is provided with an electroluminescence apparatus 30. This electroluminescence apparatus 30 may be an electroluminescence lamp, for example. FIGS. 2 to 5 illustrate the display dot 10 in that end position in which it is out of operation or inactive. In the present case, the baseplate 11 is made of an electrically insulating and transparent or at least translucent material.

In the case illustrated (FIGS. 2 and 3), the baseplate 11 has an essentially octagonal base contour. A respective lug or spur 14 and 15 which lie on a common axis A protrude from two mutually opposite sides 12 and 13 of the baseplate 11. This axis A at the same time represents the axis of rotation or pivot axis of the display dot 10. A further two sides 16 and 17, which run parallel to one another, are essentially perpendicular to said sides 12 and 13 of the baseplate 11. The edge of one of these sides 16 has a rectilinear course in the case illustrated. A cutout 17 having an arcuate contour is made, on the other hand, in the other side 17. The purpose of this cutout 17 will become evident from the text below. Those sides 18, 19, 20 and 21 of the baseplate 11 which connect said pairs of sides 12 and 13, and 16 and 17, to one another run rectilinearly in the case illustrated, although they could also have a different course.

The electroluminescence apparatus 30, which is also abbreviated simply to EL apparatus 30, inter alia, in the text below, is fitted such that it adheres on one of the large areas of the electrically insulating and transparent baseplate 11. This EL apparatus 30 comprises a first electrode 31, which can also be designated as the front electrode and is likewise transparent or at least translucent. Such electrodes are generally known and they can be produced for example by vapor depositing metal onto the baseplate 11. This front electrode 31 adheres fixedly on the baseplate 11 and it covers practically the entire surface of the baseplate 11. It extends right into the region of one of the lugs 15 on the baseplate 11, the surface of which lug is likewise covered by said electrode 31. In the region of the other lug 14, this front electrode 31 ends at a distance therefrom.

Fitted on the first electrode 31 is a layer 33 made of an electroluminescence material which covers practically the entire surface of the front electrode 31, on which it likewise fixedly adheres. The EL apparatus 30 furthermore comprises a second electrode 32, which is also designated as back electrode in the text below. This electrode 32 covers practically the entire rear side of the EL layer 33 and it extends right into the region of the other lug 14 on the baseplate 11, whose surface it likewise covers.

Contact elements 35 and 36 (FIGS. 2 to 6) made of an electrically conductive material are provided, a respective one of which is electrically conductively fastened on that portion of the respective electrode 31 and 32 which is situated in the region of one of the lugs 14 and 15, respectively. The respective contact element 35 and 36 has practically the shape of a parallelepiped which is fastened by one of its large or side areas on the lug 14 and 15, respectively. The opposite or parallel base or side area of this parallelepiped 35 and 36, respectively, is provided with a contact layer 34, for example made of gold. The width of the parallelepiped 35 and 36 is less than the width of the lug 14 and 15, respectively, carrying said parallelepiped. In addition, the contact elements 35 and 36 on the lugs 14 and 15 are arranged asymmetrically with regard to the pivot axis A.

The display unit 1 is also designed in such a way that the EL apparatus 30 can be connected optionally or controllably to a source of electrical energy (not illustrated). For this purpose, the baseplate 11 of the display dot 10 is mounted such that it can pivot. The display unit 1 comprises two supports 22 in bar form, which are arranged on mutually opposite sides 12 and 13 of the baseplate 11 and of which only the support 22 situated at the front is visible in FIG. 1. These supports 22 are fastened by one end in the carrying plate 2, from which they protrude practically at right angles. Those ends of the supports 22 which lie in the region of the carrying plate 2 are connected to those conductor tracks 41 and 42 on the carrying plate 2 which lead to said supply source for the EL apparatus 30.

A bearing sleeve 23 and 24 is fastened to the free end of the respective support 22. Both the supports 22 and the bearing sleeves 23 and 24 are made of an electrically conductive material. Consequently, the bearing sleeves 23 and 24 are connected to the supply source via the supports 22 and the abovementioned conductor tracks 41 and 42 on the carrying plate 2. That large or side area of the parallelepipedal contact element 35 and 36 which is remote from the lug 14 and 15, respectively, may be convex, in which case the curvature of this area may correspond to the curvature of the inner wall of the bearing sleeve 23 and 24, respectively.

The display unit 1 furthermore comprises a ontrollable magnetic circuit 25. This magnetic circuit 25 contains an essentially U-shaped yoke 26 with limbs 27 and 28 and with a web 29 connecting the latter. The yoke 26 is provided with a coil 9, which is fitted on the web 29 in the case illustrated. Said coil 9 is connected (not illustrated) to conductor tracks 43 and 44 on the carrying plate 2, via which it can receive the commands necessary for the functioning of the display unit 1.

The yoke 26 is arranged in such a way that the limbs 27 and 28 of the same are practically perpendicular to the carrying plate 2, and that they lie in a vertical plane. The sleeve supports 22 likewise lie in a vertical plane. These two vertical planes are practically at right angles to one another. The yoke 26 is also arranged in such a way that at least the end sections of its limbs 27 and 28 protrude from the same side of the carrying plate 2 as the supports 22. In this case, the distance of the bearing sleeves 14 and 15 and of the end faces 37 and 38 of the yoke limbs 27 and 28 from the carrying plate 2 is practically identical.

One of the spurs or lugs 14 and 15 of the baseplate 11 is mounted such that it can pivot in the respective bearing sleeve 23 and 24. This means, inter alia, that the width of the lug 14 and 15 is less than the internal diameter of the bearing sleeve 23 and 24, respectively. The width of the lug 14 and 15 is so much smaller than the internal diameter of the bearing sleeve 23 and 24, respectively, that the lug is even mounted with play in the sleeve.

Since the distance of the sleeves 14 and 15 and of the end faces 37 and 38 of the yoke limbs 27 and 28 from the carrying plate 2 is practically identical, the baseplate 11 mounted in the sleeves 23 and 24 is, at the same time, also assigned to those portions of the yoke limbs 27 and 28 which encompass the end faces 37 and 38. Since the vertical planes of the supports 22 and of the yoke limbs 27 and 28 are at right angles to one another, the end faces 37 and 38 of the yoke limbs 27 and 28 are assigned to the abovementioned perpendicular short sides 16 and 17 of the baseplate 11.

The display dot 10 is provided with a bar-shaped permanent magnet 8, which is fastened on the outer side of the back electrode 32 of the EL apparatus 30. The bar 8 is arranged in such a way that its longitudinal axis is perpendicular to the pivot axis A and that the poles N and S of the magnet 8 consequently face the yoke limbs 27 and 28. An interaction, known per se, between the magnetic circuit 25 and the permanent magnet 8 causes adjustment of the baseplate 11 and, consequently, also of the entire display dot 10 from one of the end positions of the display dot 10 into its other end position and back.

The distance between the yoke limbs 27 and 28 is set as follows. An edge of the baseplate 11 that encompasses the first perpendicular short side 16 rests on the end face 37 of one of the yoke limbs 27. That end section of the other yoke limb 28 which encompasses the end face 38 is located in the arcuate cutout in the second perpendicular side 17 of the baseplate 11. This is one of the end positions which the baseplate 11 can assume. This end position is illustrated in FIG. 2 and the display dot 10 is inactive in this end position. The large area of the baseplate 11, which large area in this case lies at the top or on the outer side, is provided with the EL apparatus 30. In this case, however, the back electrode 32 lies at the top or on the outer side of the EL apparatus 30. In the case of this first end position, the other yoke limb 28 is located in the cutout 17 in the baseplate 11 which partly surrounds said yoke limb 28. This reduces the reluctance of the gap between said yoke limb 28 and the baseplate 11.

When the display unit 1 is actuated, the baseplate 11 assumes its other end position. In this case, the short perpendicular side 16 of the base body 11 comes to rest on the end face 38 of the other yoke limb 28. The angle of the pivot movement of the baseplate 11 is in this case almost 180 degrees, with the result that the opposite large area of the baseplate 11 in the case illustrated comes to the top. This second large area of the baseplate 11 is free and, since it is made of a transparent material, the front electrode 31 of the EL apparatus 30 is now visible through the baseplate 11.

FIG. 5 shows a side view of one of the lugs 15 on the base body 11 of the display dot 10 when the latter is in one of its end positions. The baseplate 11 and, consequently, also the lug 15 are in this case situated at the bottom and the display dot 10 consequently rests above the lug 15 on the bearing sleeve 24. Since the base body 11 and the lug 15 are made of an electrically insulating material, no current can flow between the electrically conductive bearing sleeve 24 and the front electrode 31 of the display dot 10. The display dot is inactive in this case, which corresponds to the position of the same as shown in FIGS. 1 and 2.

FIG. 6 shows a side view of the other end position of the display dot 10. The baseplate 11 is in this case pivoted through almost 180 degrees with the result that the contact element 36 is now situated at the bottom and the contact layer 34 fitted on its top side rests directly on the conductive bearing sleeve 24. In this end position, current can flow via the contact layer 34 and the contact element 36 between the bearing sleeve 24 and the front electrode 31. The same situation exists in this case for the opposite bearing sleeve 23, where current can flow between the latter and the back electrode 32 via the contact layer 34 and the contact element 36. The current can in this case flow through the layer 33 made of the electroluminescence material and light is radiated from said EL apparatus 30 through the baseplate 11.

What is claimed is:

1. A display or indicating device having a plurality of display units which display a picture to be reproduced in a dot-by-dot manner, each display unit (1) comprising:

a display dot (10) comprising an electroluminescent apparatus (30);

means supporting said display dot for pivotable movement between two positions; and means for actuating the display dot (10).

2. The display or indicating device of claim 1, wherein, in each display unit:

the display dot (10) further comprises a baseplate (11) which is made of an electrically insulating and transparent or translucent material and has a rear side and mutually opposite edges (12, 13);

the electroluminescent apparatus (30) is fitted on the rear side of the baseplate (11); and each said display unit further comprises spurs or lugs (14,15) made of an electrically insulating material and protruding from the opposite edges (12,13) of the baseplate (11).

3. The display or indicating device of claim 2, wherein, in each display unit:

said electroluminescent apparatus (30) has extensive electrodes (31,32) and a layer (33) made of an electroluminescent material situated between said extensive electrodes (31,32); and said electroluminescent apparatus (30) is connectable to a source of electrical energy.

4. The display or indicating device of claim 2, wherein, in each display unit:

the means for actuating the display dot (10) comprise supports (22) in bar form, which are arranged on the mutually opposite edges (12,13) of the baseplate (11) and which are made of an electrically conductive material;

the baseplate (11) of the display dot (10) is mounted in the supports (22) such that it can pivot therein; and the means for actuating the display dot (10) further comprise a controllable magnetic circuit (25) which controls the position of the baseplate (11).

5. The display or indicating device of claim 4, wherein, in each display unit;

the magnetic circuit (25) comprises an approximately U shaped yoke (26) having limbs, (27,28), a web (29) interconnecting one pair of ends of said limbs (27,28) and a coil fitted on said web (29);

said supports (22) lie in a vertical plane;

the limbs (27,28) of said yoke lie in a vertical plane which is practically perpendicular to the vertical plane of said supports (22); and said baseplate (11) has marginal sections which are free of lugs and which are assigned to respective end sections (37,38) of one of said limbs (27,28) of the magnetic circuit (25).

6. The display or indicating device of claim 5, wherein, in each display unit:

the display dot (10) is provided with a permanent magnet (8), which is placed on a rear side of the electroluminescent apparatus (30);

one of the marginal or edge sections of the baseplate (11) is provided with a cutout (17) and is assigned to one of the limbs (28) of the magnetic circuit (25) in such a manner that the end section (38) of this limb (28) can pass through said cutout (17); and another edge section (16) of the baseplate (11) has a straight edge and can rest on the end face (37) of the other yoke limb (27).

7. The display or indicating device of claim 4, wherein, in each display unit:

each of said supports (22) is provided with a bearing sleeve (23,24) made of an electrically conductive material;

each lug (14,15) is mounted in one of said sleeves (23,24) for pivotal movement therein; and said sleeves (23,24) are connected via said supports (22) to an electric source.

8. The display or indicating device of claim 3, wherein, in each display unit:

a first one of the extensive electrodes (31) of the electroluminescent apparatus (30) adheres to the baseplate (11) and is transparent or at least translucent;

this first extensive electrode (31) extends right into the region of a first one of said lugs (15) on the baseplate (11);

the layer (33) made of an electroluminescent material is placed on top of the first extensive electrode (31);

a second one of the extensive electrodes (32) is placed on top of the layer (33) made of an electroluminescent material and extends right into the region of a second one of said lugs (14) on the baseplate (11); and each extensive electrode (31,32) ends at a point before the associated lug (14,15) to which the opposite electrode adheres or is connected.

9. The display or indicating device of claim 3, wherein, in each display unit:

the means for actuating the display dot (10) comprise supports (22) in bar form, which are arranged on the mutually opposite edges (12,13) of the baseplate (11);

each of said supports (22) is provided with a bearing sleeve (23,24) having an internal diameter;

each lug (14,15) is mounted in one of said sleeves (23,24) for pivotal movement therein;

each lug (14; 15) of the baseplate (11) is provided with a respective approximately parallelepipedal contact element (36) made of an electrically conductive material and electrically conductively connected to a portion of a respective extensive electrode (31,32) which is situated in the region of this lug (14,15);

each lug has a width and each contact element (36) has a width that is less than the width of the associated lug (14,15); and the width of each lug (14,15) is less than the internal diameter of the bearing sleeve (23,24) in which said lug is mounted.

10. The display or indicating device of claim 9, wherein, in each display unit:

each parallelepipedal contact element (36), has a large convex area which is remote from the associated lug (14,15), the convex area having a curvature corresponding to the curvature of the internal diameter of the bearing sleeve (23,24).

11. The display or indicating device of claim 10, wherein, in each display unit:

said lugs are pivotable about a pivot axis; and each contact element (36) is placed asymmetrically with regard to the pivot axis.

12. The display or indicating device of claim 1, further comprising a carrying plate (2) which carries the display units and which is provided with conductor tracks (41,42, 43,44), to which the display units (1) are electrically connected, wherein, in each display unit:

the means for actuating the display dot (10) comprise supports (22), which are arranged on the mutually opposite edges (12,13) of the baseplate (11) and which have ends that lie in the region of the carrying plate (2);

the ends of the supports (22) are connected to respective conductor tracks (41,42) that lead to a source of electrical energy for the electroluminescent apparatus (30);

the means for actuating the display dot (10) comprise a controllable magnetic circuit (25) which controls the position of the baseplate (11);

the magnetic circuit (25) comprises an approximately U shaped yoke (26) having limbs (27,28), a web (29) interconnecting one pair of ends of said limbs (27,28) and a coil (9) fitted on the web (29);

the limbs (27,28) of the magnetic circuit (25) go through said carrying plate (2), the yoke (26) of the magnetic circuit (25) is arranged in such a way that at least second ends of the limbs (27,28) remote from the one pair of ends protrude from the same side of the carrying plate (2) as the supports (22);

each of said supports (22) is provided with a bearing sleeve (23,24); and the web (29) and the coil (9) are placed on an opposite side of the carrying plate (2) from the sleeves (24,25) provided on the supports (22).

* * * * *